US011289822B2

(12) United States Patent
Goto et al.

(10) Patent No.: US 11,289,822 B2
(45) Date of Patent: Mar. 29, 2022

(54) ANTENNA DEVICE

(71) Applicant: Mitsubishi Electric Corporation, Tokyo (JP)

(72) Inventors: Jun Goto, Tokyo (JP); Takashi Maruyama, Tokyo (JP); Toru Fukasawa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 2 days.

(21) Appl. No.: 16/933,295

(22) Filed: Jul. 20, 2020

(65) Prior Publication Data

US 2020/0350694 A1 Nov. 5, 2020

Related U.S. Application Data

(63) Continuation of application No. PCT/JP2018/002325, filed on Jan. 25, 2018.

(51) Int. Cl.

| | |
|---|---|
| ***H01Q 21/06*** | (2006.01) |
| ***H01Q 21/00*** | (2006.01) |
| ***H01Q 1/00*** | (2006.01) |
| ***H01Q 9/04*** | (2006.01) |

(52) U.S. Cl.
CPC ..... *H01Q 21/0075* (2013.01); *H01Q 1/002* (2013.01); *H01Q 9/0407* (2013.01)

(58) Field of Classification Search
CPC ..... H01Q 21/065; H01Q 1/38; H01Q 21/0075
See application file for complete search history.

(56) References Cited

U.S. PATENT DOCUMENTS

| | | | | |
|---|---|---|---|---|
| 4,914,445 | A | 4/1990 | Shoemaker | |
| 6,856,277 | B2 | 2/2005 | Katayama et al. | |
| 10,224,644 | B1 * | 3/2019 | Park | H01Q 21/065 |
| 10,498,023 | B2 * | 12/2019 | Lin | H01Q 21/0075 |
| 2014/0218259 | A1 * | 8/2014 | Lee | H01Q 21/065 343/852 |

FOREIGN PATENT DOCUMENTS

| | | | |
|---|---|---|---|
| CN | 107508039 | A | 12/2017 |
| JP | 11-145719 | A | 5/1999 |
| JP | 11-251833 | A | 9/1999 |
| JP | 2003-174318 | A | 6/2003 |
| JP | 2008-236740 | A | 10/2008 |
| JP | 2010-193052 | A | 9/2010 |
| JP | 2017-73637 | A | 4/2017 |

OTHER PUBLICATIONS

International Search Report issued in PCT/JP2018/002325 (PCT/ISA/210), dated Mar. 13, 2018.
European Office Action for European Application No. 18 902 178.5, dated Jul. 13, 2021.
Extended European Search for European Application No. 18902178.5, dated Nov. 20, 2020.

* cited by examiner

*Primary Examiner* — Hasan Islam
(74) *Attorney, Agent, or Firm* — Birch, Stewart, Kolasch & Birch, LLP

(57) ABSTRACT

In radiation elements, recessed portions for adjusting the power of an electromagnetic wave that passes through the radiation elements are formed as power adjustment portions at coupling portions, respectively, which are on the opposite side of a feeding unit out of sets of two coupling portions to a feed line.

5 Claims, 6 Drawing Sheets

ANTENNA DEVICE

CROSS REFERENCE TO RELATED APPLICATIONS

This application is a Continuation of PCT International Application No. PCT/JP2018/002325, filed on Jan. 25, 2018, which is hereby expressly incorporated by reference into the present application.

TECHNICAL FIELD

The present invention relates to an antenna device including multiple radiation elements.

BACKGROUND ART

Patent Literature 1 below discloses an antenna device including multiple radiation elements.

The antenna device includes a dielectric substrate. A ground conductor layer is formed on the lower surface of the dielectric substrate, and a feed line is formed on its top surface.

Multiple radiation elements are arrayed at equal intervals on the feed line formed on the top surface of the dielectric substrate, and the multiple radiation elements are coupled in series by the feed line.

Since the multiple radiation elements are arranged symmetrically with respect to a feeding unit included in the feed line, the orientation of an electromagnetic wave radiated from the antenna device is perpendicular to the top surface of the dielectric substrate (hereinafter referred to as the "front direction of the antenna device").

CITATION LIST

Patent Literatures

Patent Literature 1: JP 2003-174318 A

SUMMARY OF INVENTION

Technical Problem

In the conventional antenna device including the multiple radiation elements, there is a disadvantage that it is not possible to set the orientation of an electromagnetic wave with respect to the front direction of the antenna device to any direction desired by a user.

The present invention has been devised to solve the disadvantage as described above, and an object of the present invention is to provide an antenna device capable of setting the orientation of the electromagnetic wave with respect to the front direction of the antenna device to any direction desired by the user.

Solution to Problem

An antenna device according to the present invention includes: a feeding unit for feeding an electromagnetic wave; a ground conductor; a substrate having a first plane on which the feeding unit is formed and a second plane on which the ground conductor is formed, the second plane being opposite to the first plane; a feed line having one end coupled to the feeding unit, the feed line being a strip conductor formed on the first plane; and N (N is an integer greater than or equal to 2) radiation elements formed by a strip conductor in the feed line, the radiation elements including one or more coupling portions to the feed line, in which each of a first to an (N−1)th radiation elements out of the N radiation elements, when counted from the feeding unit side, is formed with a recessed portion for adjusting power of the electromagnetic wave that passes through the radiation element as a power adjustment portion at one of two coupling portions to the feed line that is on an opposite side of the feeding unit, wherein one or more radiation elements out of the N radiation elements are formed with a hole.

Advantageous Effects of Invention

According to the present invention, the antenna device is structured so that each of the first to the (N−1)th radiation elements out of the N radiation elements, when counted from the feeding unit side, is formed with a recessed portion for adjusting the power of the electromagnetic wave that passes through the radiation element as a power adjustment portion at one of the two coupling portions to the feed line that is on the opposite side of the feeding unit. Therefore, the antenna device according to the present invention is capable of setting the orientation of an electromagnetic wave with respect to the front direction of the antenna device to any direction desired by a user.

DESCRIPTION OF EMBODIMENTS

To describe the present invention further in detail, embodiments for carrying out the present invention will be described below with reference to the accompanying drawings.

First Embodiment

FIG. 1 is a configuration diagram illustrating an antenna device according to a first embodiment.

Figure 1A:
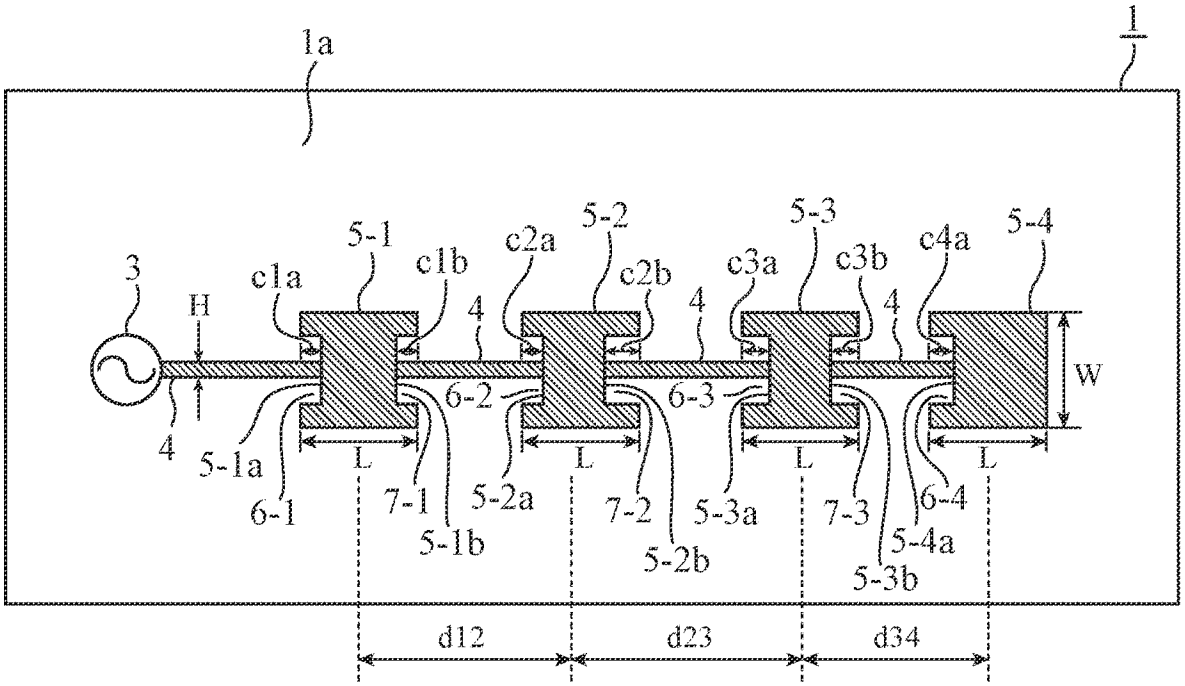
FIG. 1A is a plan view illustrating an antenna device according to a first embodiment.
Figure 1B:
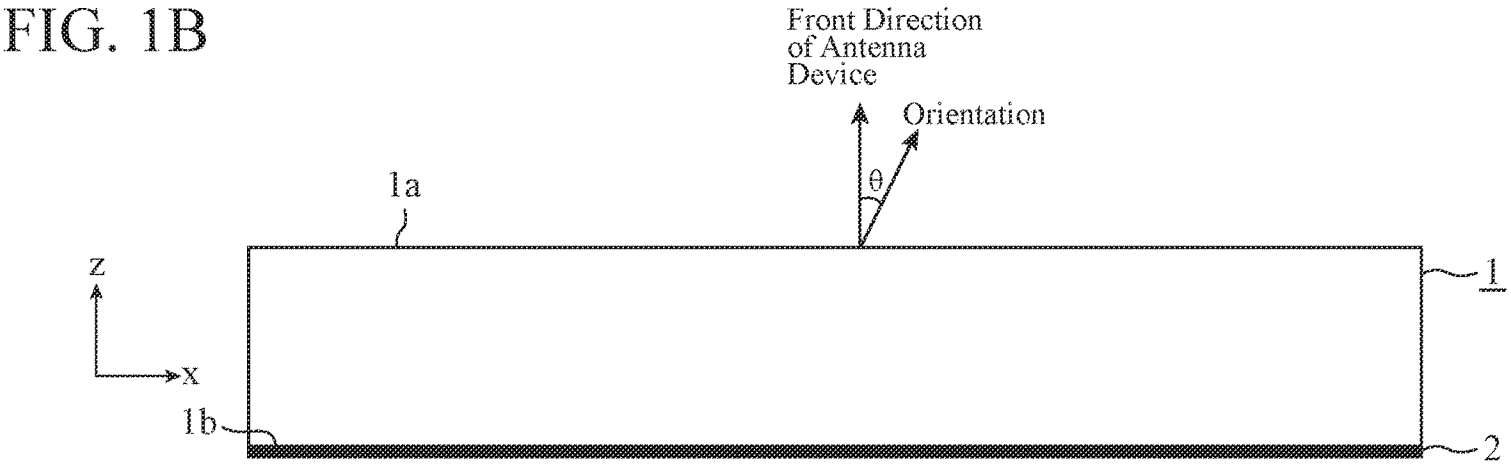
FIG. 1B is a side view illustrating the antenna device according to the first embodiment.

FIG. 1A is a plan view illustrating the antenna device according to the first embodiment, and FIG. 1B is a side view illustrating the antenna device according to the first embodiment.

In FIG. 1, a dielectric substrate 1 has a first plane 1*a* and a second plane 1*b*. The first plane 1*a* and the second plane 1*b* are opposite to each other.

In the dielectric substrate 1, a feeding unit 3 that feeds an electromagnetic wave is formed on the first plane 1*a*, and a ground conductor 2 is formed on the second plane 1*b*.

The ground conductor 2 is a grounding surface that is uniformly formed on the second plane 1*b* of the dielectric substrate 1.

As illustrated in FIG. 1A, each of the first plane 1*a* and the second plane 1*b* is parallel to an x-y plane that is a plane including the x axis and the y axis. Note that the direction of the z axis is perpendicular to the x-y plane as illustrated in FIG. 1B.

The feeding unit 3 is coupled with, for example, a radio frequency (RF) connector and feeds an electromagnetic wave that is input from the second plane 1*b* side of the dielectric substrate 1 via an RF connector to a feed line 4.

The feed line 4 is a strip conductor having one end coupled with the feeding unit 3 and formed on the first plane 1*a* of the dielectric substrate 1.

N (N is an integer greater than or equal to 2) radiation elements 5-*n* (n=N) are antenna elements formed on the feed line 4 by strip conductors.

The antenna device of FIG. 1A illustrates an example in which N=4 holds and four radiation elements 5-*n* are formed; however, it is only required that two or more radiation elements 5-*n* be formed.

In the example of N=4, the radiation elements 5-1 to 5-3 are the first to (N−1)th (=3rd) radiation elements among the four radiation elements 5-*n* (n=1, 2, 3, 4) when counted from the feeding unit 3 side.

Out of the N radiation elements 5-*n*, the first to the (N−1)th radiation elements 5-1 to 5-(N−1) when counted from the feeding unit 3 side each have two coupling portions for the feed line 4.

In the example of N=4, the radiation elements 5-*n* (n=1, 2, 3) each include two coupling portions 5-*na* and 5-*nb* for the feed line 4.

A coupling portion 5-*na* is on the feeding unit 3 side in the radiation element 5-*n*, and the coupling portion 5-*nb* is on the opposite side to the feeding unit 3 in the radiation element 5-*n*.

Out of the N radiation elements 5-*n*, the Nth radiation element 5-N when counted from the feeding unit 3 side has one coupling portion for the feed line 4.

In the example of N=4, the radiation element 5-4 includes one coupling portion 5-4*a* for the feed line 4, and the coupling portion 5-4*a* is on the feeding unit 3 side in the radiation element 5-4.

The radiation element 5-4 is disposed at the other end of the feed line 4 and functions as an impedance matching element.

Impedance matching portions 6-1 to 6-4 are recessed portions formed in the coupling portions 5-1*a* to 5-4*a* of the radiation elements 5-1 to 5-4, respectively.

The impedance matching portions 6-1 to 6-4 are formed for adjustment of the input impedances of the radiation elements 5-1 to 5-4, respectively, and the more recessed, the lower an input impedance becomes.

The depths of the recesses in the impedance matching portions 6-1 to 6-4 are recess amounts c1*a*, c2*a*, c3*a*, and c4*a* in the x axis direction, respectively.

Power adjustment portions 7-1 to 7-3 are recessed portions formed in the coupling portions 5-1*b* to 5-3*b* of the radiation elements 5-1 to 5-3, respectively.

The power adjustment portions 7-1 to 7-3 are formed to adjust the power of the electromagnetic wave that passes through the radiation elements 5-1 to 5-3, respectively. The more recessed, the larger the passing power of the electromagnetic waves becomes.

The depths of the recesses in the power adjustment portions 7-1 to 7-3 are recess amounts c1*b*, c2*b*, and c3*b* in the x axis direction, respectively.

The shapes of the radiation elements 5-1 to 5-4 in the antenna device of FIG. 1A are rectangular if the impedance matching portions 6-1 to 6-4 and the power adjustment portions 7-1 to 7-3 are not formed. However, the shapes of the radiation elements 5-1 to 5-4 may be any quadrangle other than a rectangle as long as the impedance matching portions 6-1 to 6-4 and the power adjustment portions 7-1 to 7-3 can be formed.

The patch lengths that are the lengths in the x direction of the radiation elements 5-1 to 5-4 each measure L.

In the example of FIG. 1A, the patch length L in each of the radiation elements 5-1 to 5-4 is all the same.

The patch widths, which are the lengths in they direction of the radiation elements 5-1 to 5-4 each measure W.

In the example of FIG. 1A, the patch width Win each of the radiation elements 5-1 to 5-4 is all the same.

The arrangement intervals of the radiation elements 5-1 to 5-4 in the antenna device of FIG. 1A are unequal.

Symbol d12 denotes the interval between the radiation element 5-1 and the radiation element 5-2, d23 denotes the interval between the radiation element 5-2 and the radiation element 5-3, and d34 denotes the interval between the radiation element 5-3 and the radiation element 5-4.

Next, an operation principle when the antenna device of FIG. 1 is used as a transmission antenna will be described.

First, an electromagnetic wave is input to the feeding unit 3 from the second plane 1*b* side of the dielectric substrate 1 via an RF connector (not illustrated).

The feeding unit 3 feeds the input electromagnetic wave to the feed line 4.

The electromagnetic wave fed from the feeding unit 3 to the feed line 4 passes through the feed line 4 and reaches the radiation element 5-1.

A part of the electromagnetic wave that has reached the radiation element 5-1 is radiated from the radiation element 5-1 to a space.

A part of the electromagnetic wave that has reached the radiation element 5-1 is reflected by the radiation element 5-1, and returns to the feeding unit 3 side as a reflection wave.

A part of the electromagnetic wave that has reached the radiation element 5-1, and that is not radiated from the radiation element 5-1 and is not reflected by the radiation element 5-1 passes through the feed line 4 and reaches the radiation element 5-2.

A part of the electromagnetic wave that has reached the radiation element 5-2 is radiated from the radiation element 5-2 to the space.

A part of the electromagnetic wave that has reached the radiation element 5-2 is reflected by the radiation element 5-2, and returns to the feeding unit 3 side as a reflection wave.

A part of the electromagnetic wave that has reached the radiation element 5-2, and that is not radiated from the radiation element 5-2 and is not reflected by the radiation element 5-2 passes through the feed line 4 and reaches the radiation element 5-3.

A part of the electromagnetic wave that has reached the radiation element 5-3 is radiated from the radiation element 5-3 to the space.

A part of the electromagnetic wave that has reached the radiation element 5-3 is reflected by the radiation element 5-3, and returns to the feeding unit 3 side as a reflection wave.

A part of the electromagnetic wave that has reached the radiation element 5-3, and that is not radiated from the radiation element 5-3 and is not reflected by the radiation element 5-3 passes through the feed line 4 and reaches the radiation element 5-4.

A part of the electromagnetic wave that has reached the radiation element 5-4 is radiated from the radiation element 5-4 to the space.

Out of the electromagnetic wave that has reached the radiation element 5-4, a part of the electromagnetic wave that is not radiated from the radiation element 5-4 is reflected by the radiation element 5-4 and returns to the feeding unit 3 side as a reflection wave.

Here, the orientation θ of an electromagnetic wave radiated from each of the radiation elements 5-1 to 5-4 is determined by the radiation pattern of the antenna device. As illustrated in FIG. 1B, the orientation θ of an electromagnetic wave is represented by an angle formed with the front direction of the antenna device. The front direction of the antenna device corresponds to the z axis direction perpendicular to the first plane 1*a* of the dielectric substrate 1 as illustrated in FIG. 1B.

The radiation pattern of the antenna device is a spatial pattern of the electromagnetic wave radiated from the antenna device.

The amount of the electromagnetic waves radiated from each of the radiation elements 5-1 to 5-4 can be adjusted by separately adjusting the patch length L of each of the radiation elements 5-1 to 5-4, the patch width W of each of the radiation elements 5-1 to 5-4, and the line width H of the feed line 4.

However, in the example of FIG. 1A, the patch lengths L of the radiation elements 5-1 to 5-4 are all the same, and the patch widths W of the radiation elements 5-1 to 5-4 are all the same. Furthermore, the length in they axis direction of the feed line 4 that is the line width H of the feed line 4 is constant from the feeding unit 3 to the radiation element 5-4. In FIG. 1A, an example is illustrated in which the patch lengths L are all the same, the patch widths W are all the same, and the length of the feed line 4 in the y axis direction is constant; however, this is merely an example. Therefore, not all the patch lengths L need to be the same, not all the patch widths W need to be the same, and the length of the feed line 4 in they axis direction may not be constant.

In the antenna device illustrated in FIG. 1A, a single array antenna is formed on the dielectric substrate 1 with a set of the feeding unit 3, the feed line 4, and N radiation elements 5-*n* serving as one array antenna. However, two or more sets of array antennas may be formed in an antenna device.

In an antenna device in which two or more sets of array antennas are formed, assuming that the patch width W of each of the two or more sets of array antennas can be adjusted, the two or more sets of array antennas may interfere with each other depending on the patch width W after adjustment. Therefore, in a case where an antenna device in which the patch width W can be adjusted is configured, it is necessary to adjust the interval(s) between the two or more array antennas in order to prevent interference between the two or more array antennas. In the first embodiment, an example is illustrated in which the patch width W is not adjusted in order to eliminate the need to adjust the interval(s) between the two or more sets of array antennas.

Furthermore, in an antenna device in which the patch length L in each of the radiation elements 5-1 to 5-4 can be adjusted, the length in the x axis direction may become too long depending on the adjusted patch length L. In the first embodiment, an example is illustrated in which the patch length L is not adjusted in order to prevent the length of the antenna device in the x axis direction from becoming too long.

Since the antenna device of the first embodiment has recessed portions as the power adjustment portions 7-1 to 7-3, the amount of electromagnetic waves radiated from each of the radiation elements 5-1 to 5-4 can be separately adjusted by adjusting each recess amount c1*b*, c2*b*, c3*b* in the power adjustment portions 7-1 to 7-3 and the arrangement intervals d12, d23, and d34 of each arrangement.

The amount of electromagnetic waves radiated from each of the radiation elements 5-1 to 5-4 varies depending on the power of the electromagnetic waves reflected by each of the radiation elements 5-1 to 5-4. The power of the electromagnetic wave reflected by each of the radiation elements 5-1 to 5-4 varies as the input impedance of each of the radiation elements 5-1 to 5-4 is adjusted.

The recess amounts c1*a*, c2*a*, c3*a*, and c4*a* in the impedance matching portions 6-1 to 6-4 are parameters for adjusting the input impedances of the radiation elements 5-1 to 5-4, respectively.

Accordingly, the recess amounts c1*a*, c2*a*, c3*a*, and c4*a* in the impedance matching portions 6-1 to 6-4, respectively, can be parameters for separately adjusting the radiation amounts of electromagnetic waves.

For this reason, an antenna device is illustrated in the first embodiment in which each of the recess amounts c1*a*, c2*a*, c3*a*, and c4*a* in the impedance matching portions 6-1 to 6-4 is also adjusted.

FIG. 2 is an explanatory diagram illustrating an excitation amplitude distribution for obtaining a desired radiation pattern.

Figure 2A:
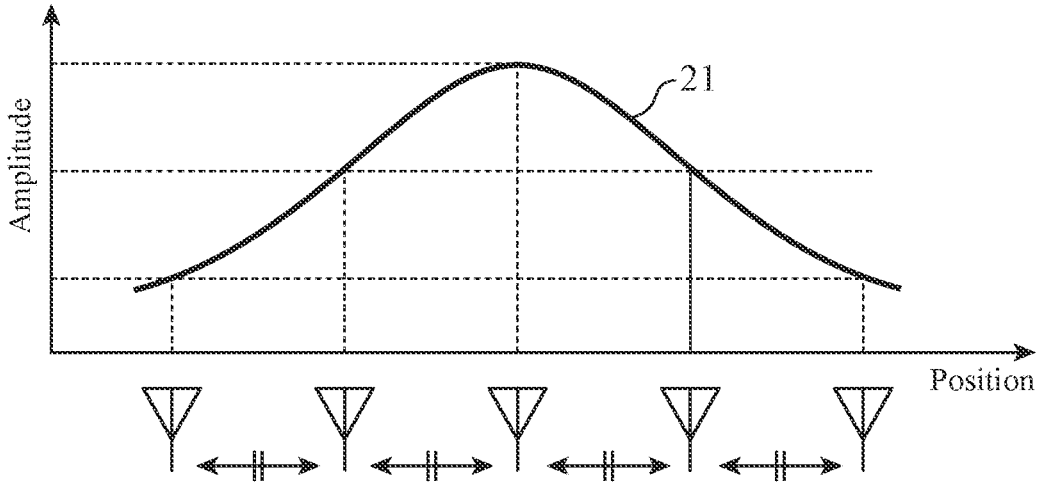
FIG. 2A is an explanatory graph illustrating the relationship between the positions of five radiation elements arranged at equal intervals and the excitation amplitude of the five radiation elements.

FIG. 2A illustrates the relationship between the positions of five radiation elements arranged at equal intervals and excitation amplitudes of the five radiation elements. In FIG. 2A, curve 21 represents an excitation amplitude distribution.

Figure 2B:
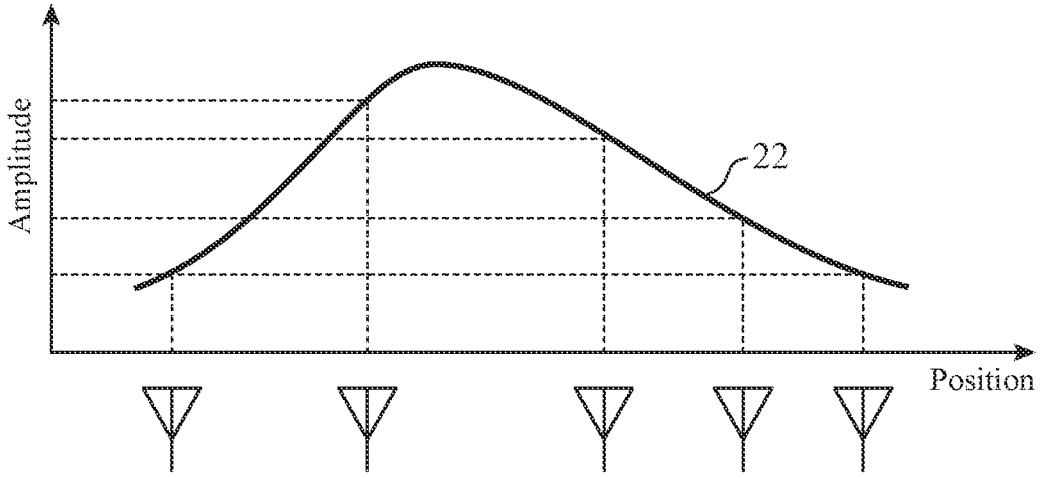
FIG. 2B is an explanatory graph illustrating the relationship between the positions of the five radiation elements arranged at unequal intervals and the excitation amplitude of the five radiation elements.

Meanwhile, FIG. 2B illustrates the relationship between the positions of five radiation elements arranged at unequal intervals and excitation amplitudes of the five radiation elements. In FIG. 2B, curve 22 represents an excitation amplitude distribution.

The excitation amplitude distribution for obtaining a desired radiation pattern can be calculated using, for example, a known genetic algorithm.

When the orientation of an electromagnetic wave is tilted by θ from the front direction of the antenna device, for example, a computer sets the arrangement intervals d12, d23, and d34 and the like in the radiation elements 5-1 to 5-4 by the following procedure.

[Step (1)]

First, the computer sets a radiation pattern that corresponds to the orientation θ of an electromagnetic wave.

For convenience of explanation, it is assumed here that the excitation amplitude distribution for obtaining the set radiation pattern is the excitation amplitude distribution 22 illustrated in FIG. 2B. In FIG. 2B, the number of radiation elements is five, which is different from the number of radiation elements 5-1 to 5-4 (=4) illustrated in FIG. 1; however, a case is illustrated in FIG. 2B for convenience of explanation in which the number of the radiation elements illustrated FIG. 1 is assumed to be five.

[Step (2)]

At the time when the computer has set the radiation pattern that corresponds to the orientation θ of the electromagnetic wave, the arrangement intervals d12, d23, d34 of the radiation elements 5-1 to 5-4 are unknown. Therefore, the computer provisionally sets the arrangement intervals d12, d23, d34 of the radiation elements 5-1 to 5-4.

The arrangement intervals d12, d23, and d34 in the radiation elements 5-1 to 5-4 may be provisionally set to any arrangement intervals. In one example, the arrangement intervals d12, d23, and d34 are provisionally set at equal intervals in the radiation elements 5-1 to 5-4 as illustrated in FIG. 2A. In FIG. 2A, the number of radiation elements is five, which is different from the number of radiation elements 5-1 to 5-4 (=4) illustrated in FIG. 1; however, a case is illustrated in FIG. 2A for convenience of explanation in which the number of the radiation elements illustrated FIG. 1 is assumed to be five.

[Step (3)]

The computer calculates an excitation amplitude distribution (hereinafter referred to as the "provisional distribution") that approximates an excitation amplitude distribution in which a radiation pattern that corresponds to the orientation θ of the electromagnetic wave can be obtained by using, for example, a known genetic algorithm in the state where the arrangement intervals d12, d23, and d34 are provisionally set.

In the calculation process of the provisional distribution using the genetic algorithm, the provisional distribution is calculated while numerical values indicating each recess amount c1*a*, c2*a*, c3*a*, and c4*a* in the impedance matching portions 6-1 to 6-4 and numerical values indicating each recess amount c1*b*, c2*b*, and c3*b* in the power adjustment portions 7-1 to 7-3 are being adjusted.

The calculated provisional distribution is an excitation amplitude distribution in a state where the arrangement intervals d12, d23, and d34 are provisionally set, and the arrangement intervals d12, d23, and d34 are not always appropriate. Therefore, the calculated provisional distribution may be different from the excitation amplitude distribution in which a radiation pattern that corresponds to the orientation θ of the electromagnetic wave is obtained.

[Step (4)]

Step (4) is executed in a case where the calculated provisional distribution is different from the excitation amplitude distribution in which the radiation pattern that corresponds to the orientation θ of the electromagnetic wave is obtained.

The computer performs an electromagnetic field simulation of a first passing phase $\varphi_1(i)$ that is the phase of an electromagnetic wave that passes through an i-th radiation element 5-*i* in a case where the excitation amplitude distribution of the antenna device is the provisional distribution calculated in step (3). The i-th radiation element 5-*i* is the i-th radiation element when counted from the feeding unit 3 side, where i=1, 2, 3. The electromagnetic field simulation by the computer is performed for each of the radiation elements 5-*i* where i=1, 2, 3.

The computer also performs an electromagnetic field simulation of a second passing phase $\varphi_2(i)$ that is the phase of the electromagnetic wave passing through the feed line 4 between the i-th radiation element 5-*i* and the (i+1)th radiation element 5-(*i*+1).

The electromagnetic field simulation of each of the first passing phase $\varphi_1(i)$ and the second passing phase $\varphi_2(i)$ is, for example, a simulation performed by the computer. Since the electromagnetic field simulation itself of each of the first passing phase $\varphi_1(i)$ and the second passing phase $\varphi_2(i)$ is known technology, detailed description thereof is omitted.

[Step (5)]

The computer sets a line length d(i) of the feed line 4 between the i-th radiation element 5-*i* and the (i+1)th radiation element 5-(*i*+1) so that the sum of the first passing phase $\varphi_1(i)$ and the second passing phase $\varphi_2(i)$ satisfies the following conditional expression.

$$\varphi_1+\varphi_2(i)=-k\times d(i)\times\sin\theta+2m\pi \qquad \text{[Conditional Expression]}$$

Term d(i) represents the line length of the feed line 4 between the i-th radiation element 5-*i* and the (i+1)th radiation element 5-(*i*+1), and k represents the wave number at the used frequency of the electromagnetic wave, and m is an integer.

[Step (6)]

The computer sets the arrangement interval d12 between the radiation elements 5-1 and 5-2 to the line length d(1), and sets the arrangement interval d23 between the radiation elements 5-2 and 5-3 to the line length d(2).

The computer also sets the arrangement interval d34 between the radiation elements 5-3 and 5-4 to the line length d(3).

The computer calculates a provisional distribution by using, for example, a known genetic algorithm in the state where the arrangement intervals d12, d23, and d34 are set as described above.

In the calculation process of the provisional distribution using the genetic algorithm, the provisional distribution is calculated while numerical values indicating each recess amount c1*a*, c2*a*, c3*a*, and c4*a* in the impedance matching portions 6-1 to 6-4 and numerical values indicating each recess amount c1*b*, c2*b*, and c3*b* in the power adjustment portions 7-1 to 7-3 are being adjusted.

[Step (7)]

The computer calculates the level of convergence between the provisional distribution calculated in step (6) and the excitation amplitude distribution that provides the radiation pattern in which the radiation pattern that corresponds to the orientation θ of the electromagnetic wave is obtained, and determines that calculation of the excitation amplitude distribution has converged if the calculated level of convergence is higher than a reference level of convergence that indicates a convergence condition. Since the process itself for calculating the level of convergence of the two excitation amplitude distributions is known technology, detailed description thereof will be omitted.

When the computer determines that calculation of the excitation amplitude distribution has converged, the computer employs the arrangement intervals d12, d23, and d34 set in step (6) as design values of the antenna device.

In addition, the computer adopts each recess amount c1*a*, c2*a*, c3*a*, and c4*a* in the impedance matching portions 6-1 to 6-4 corresponding to the provisional distribution calculated in step (6) as design values of the antenna device.

Furthermore, the computer employs each recess amount c1*b*, c2*b*, and c3*b* in the power adjustment portions 7-1 to 7-3 corresponding to the provisional distribution calculated in step (6) as design values of the antenna device.

If the computer determines that calculation of the provisional distribution has not converged, the computer repeats steps (4) to (7).

In step (4), however, the computer performs an electromagnetic field simulation of each of the first passing phase $\varphi_1(i)$ and the second passing phase $\varphi_2(i)$ using the provisional distribution calculated in step (6) instead of the provisional distribution calculated in step (3).

The antenna device of the first embodiment is capable of setting the orientation θ of an electromagnetic wave at a desirable direction and setting the orientation θ of the electromagnetic wave also to the front direction of the antenna device.

The antenna device according to the first embodiment is capable of emitting the electromagnetic wave in the front direction of the antenna device when all of the radiation elements 5-1 to 5-4 are excited in phase even if the arrangement intervals d12, d23, and d34 of the radiation elements 5-1 to 5-4 are unequal.

The conditions under which all of the radiation elements 5-1 to 5-4 are excited in phase are as follows.

Let the sum of the first passing phase $\varphi_1(1)$ in the radiation element 5-1 and the second passing phase $\varphi_2(1)$ in the feed line 4 between the radiation element 5-1 and the radiation element 5-2 be $\Phi(1)$.

Let the sum of the first passing phase $\varphi_1(2)$ in the radiation element 5-2 and the second passing phase $\varphi_2(2)$ in the feed line 4 between the radiation element 5-2 and the radiation element 5-3 be $\Phi(2)$.

Let the sum of the first passing phase $\varphi_1(3)$ in the radiation element 5-3 and the second passing phase $\varphi_2(3)$ in the feed line 4 between the radiation element 5-3 and the radiation element 5-4 be $\Phi(3)$.

Here, if $\Phi(1)=\Phi(2)=\Phi(3)$ holds, all of the radiation elements 5-1 to 5-4 are excited in phase.

When all of the radiation elements 5-1 to 5-4 are excited in phase, an electromagnetic wave is emitted in the front direction of the antenna device.

In the antenna device according to the first embodiment described above, in the radiation elements 5-1 to 5-3, recessed portions for adjusting the power of an electromagnetic wave that passes through the radiation elements are formed as the power adjustment portions 7-1 to 7-3 at the coupling portions 5-1*b* to 5-3*b*, respectively, that is on the opposite side of the feeding unit 3. Therefore, the antenna device of the first embodiment can set the orientation of the electromagnetic wave with respect to the front direction of the antenna device at any direction desired by a user by adjusting the depth of each of the recesses in the power adjustment portions 7-1 to 7-3 and the arrangement of the radiation elements 5-1 to 5-4.

Although the antenna device of the first embodiment includes the dielectric substrate 1, for example a spacer formed of a foaming agent may be used as a substrate instead of the dielectric substrate 1.

In a case where the spacer is used as the substrate, each of the feed line 4 and the radiation elements 5-1 to 5-4 may be formed of a conductor plate or the like.

In the antenna device according to the first embodiment, the radiation elements 5-1 to 5-4 are formed on the first plane 1*a* of the dielectric substrate 1.

The antenna device according to the first embodiment may include a multilayer substrate in which another dielectric substrate, in which a parasitic element is formed, is stacked on the first plane 1*a* of the dielectric substrate 1.

In addition, in the antenna device of the first embodiment, a polarizer may be included in the z axis direction of the first plane 1*a* of the dielectric substrate 1. Since a polarizer has a function of converting the polarization state of the electromagnetic waves radiated from the radiation elements 5-1 to 5-4, it becomes possible to use the antenna device of the first embodiment as an antenna device that operates, for example, as a circularly polarized antenna.

Second Embodiment

In a second embodiment, an antenna device will be described in which one or more of N radiation elements are formed with a hole.

Figure 3:
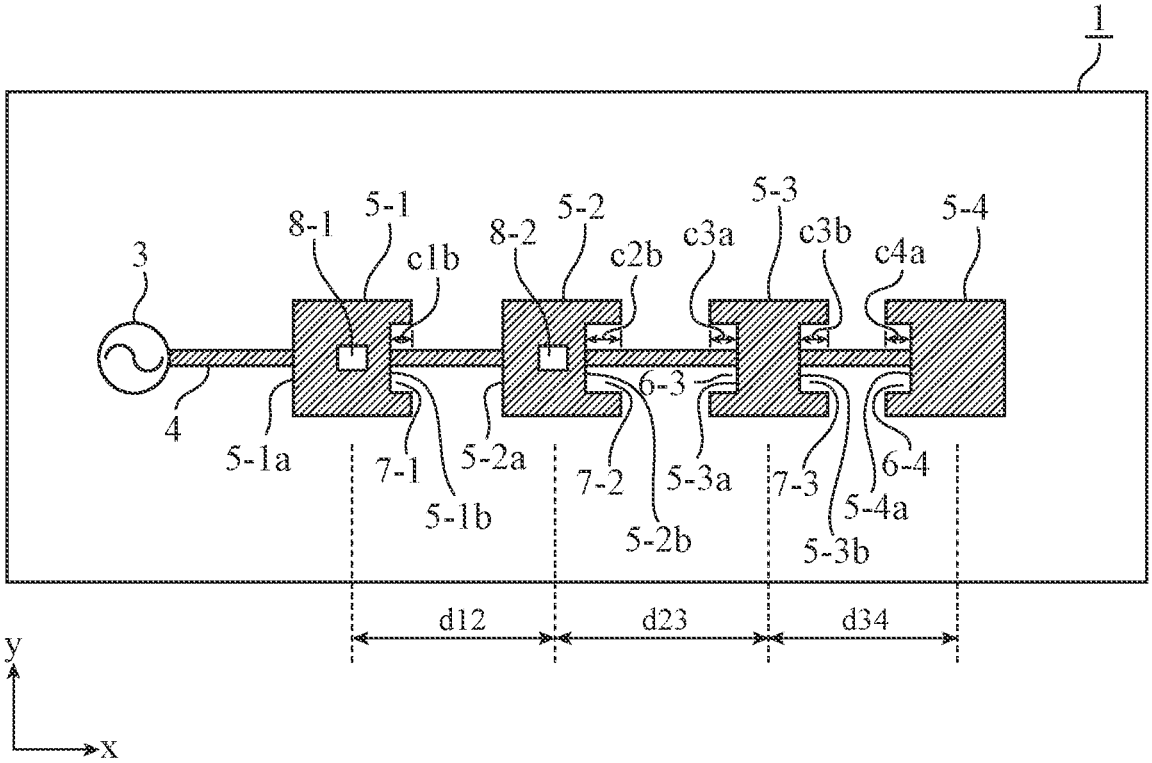
FIG. 3 is a plan view illustrating an antenna device according to a second embodiment.

FIG. 3 is a plan view illustrating an antenna device according to the second embodiment.

In FIG. 3, the same symbol as that in FIG. 1A represents the same or a corresponding part, and thus description thereof is omitted.

A hole 8-1 is formed in a radiation element 5-1.

A hole 8-2 is formed in a radiation element 5-2.

The radiation elements 5-1 and 5-2 provided with the holes 8-1 and 8-2, respectively, have higher input impedances as compared to the radiation elements 5-1 and 5-2 in a case where the holes 8-1 and 8-2 are not formed.

The antenna device illustrated in FIG. 3 illustrates an example in which the holes 8-1 and 8-2 are formed at the center positions of the radiation elements 5-1 and 5-2, respectively; however, the holes 8-1 and 8-2 may be formed at positions shifted from the center positions of the radiation elements 5-1 and 5-2.

The antenna device illustrated in FIG. 3 illustrates an example in which the holes 8-1 and 8-2 are formed in the two radiation elements 5-1 and 5-2; however, the number of radiation elements formed with a hole is not limited to two, and one radiation element or three or more radiation elements may be formed with a hole.

Furthermore, the antenna device illustrated in FIG. 3 illustrates an example in which the holes 8-1 and 8-2 are formed in the radiation elements 5-1 and 5-2 on the feeding unit 3 side out of the radiation elements 5-1 to 5-4; however, any radiation element may be formed with a hole.

Next, the operating principle of the antenna device illustrated in FIG. 3 will be described.

First, in the antenna device illustrated in FIG. 1, each input impedance of the radiation elements 5-1 to 5-4 can be adjusted by adjusting each recess amount c1*a*, c2*a*, c3*a*, and c4*a* in the impedance matching portions 6-1 to 6-4.

Note that the input impedances of the radiation elements 5-1 to 5-4 become higher as the recess amounts c1*a*, c2*a*, c3*a*, and c4*a* become smaller, respectively.

Therefore, in a case where each of the recess amounts c1*a*, c2*a*, c3*a*, and c4*a* equals zero and there is no recess as the impedance matching portions 6-1 to 6-4, the input impedance in each of the radiation elements 5-1 to 5-4 becomes the highest.

There are cases where input impedances of the radiation elements 5-1 to 5-4 that minimize the reflection amount of the electromagnetic waves at the coupling portions 5-1*a* to 5-4*a* of the radiation elements 5-1 to 5-4 are higher than input impedances in a case where there are no recesses as the impedance matching portions 6-1 to 6-4, respectively.

In such a case, input impedances of the radiation elements 5-1 to 5-4 can be matched to the input impedances that minimize the reflection amount of electromagnetic waves by forming holes in the radiation elements 5-1 to 5-4 and further increasing the input impedances of the radiation elements 5-1 to 5-4.

In the antenna device illustrated in FIG. 3, the holes 8-1 and 8-2 are formed in the radiation elements 5-1 and 5-2, respectively.

Moreover, in the antenna device illustrated in FIG. 3, the recess amounts c1*a* and c2*a* in the impedance matching portions 6-1 and 6-2 equal zero, and there is no recess as the impedance matching portions 6-1 and 6-2.

Let us assume that the amounts of increase in the input impedances of the radiation elements 5-1 and 5-2 due to formation of the holes 8-1 and 8-2 are $\Delta I_{1up}$ and $\Delta I_{2up}$, respectively.

Therefore, in the antenna device illustrated in FIG. 3, the input impedances of the radiation elements 5-1 and 5-2 can be increased by $\Delta I_{1up}$ and $\Delta I_{2up}$ as compared to the input impedances in a state where there is no recess as the impedance matching portions 6-1 and 6-2, respectively.

As described above, in the antenna device according to the second embodiment, an input impedance in each of the radiation elements 5-1 to 5-4 can be adjusted by whether to form a hole in each of the radiation elements 5-1 to 5-4 and adjusting each of the recess amounts c1*a*, c2*a*, c3*a*, and c4*a*.

Figure 4:
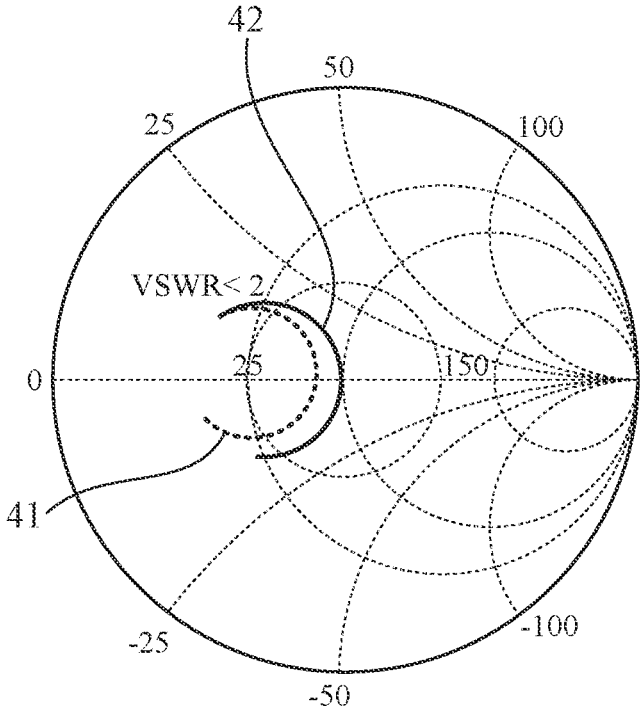
FIG. 4 is an explanatory diagram illustrating an electromagnetic field simulation result of electrical characteristics in the antenna device of the second embodiment.

Here, FIG. 4 is an explanatory diagram illustrating an electromagnetic field simulation result of electrical characteristics in the antenna device of the second embodiment. In FIG. 4, an example is illustrated in which an antenna device includes nine radiation elements.

In FIG. 4, a curve 41 represents the input impedance of two radiation elements on a feeding unit 3 side out of the nine radiation elements in a case where none of the nine radiation elements are formed with a hole.

A curve 42 represents the input impedance of the two radiation elements on the feeding unit 3 side out of the nine radiation elements in a case where the two radiation elements on the feeding unit 3 side are formed with a hole out of the nine radiation elements.

In a case where the two radiation elements on the feeding unit 3 side are not formed with a hole, impedance matching cannot be achieved since the input impedance is too low as illustrated by the curve 41 in FIG. 4.

In a case where the two radiation elements on the feeding unit 3 side are formed with a hole, impedance matching may be achieved since the input impedance is increased than in the case where no holes are formed as illustrated by the curve 42 in FIG. 4.

Figure 5:
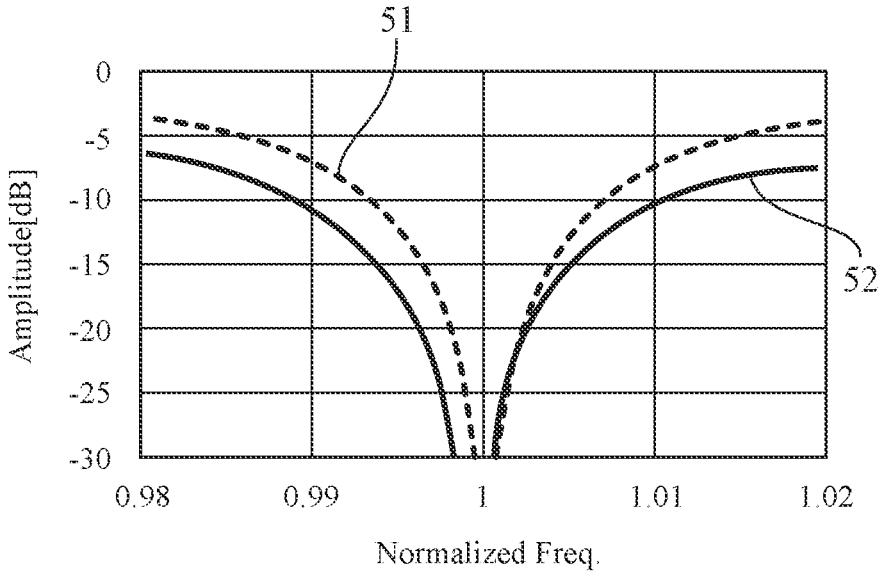
FIG. 5 is an explanatory graph illustrating electromagnetic field simulation results of reflection characteristics in each of a standing-wave array antenna and a traveling-wave array antenna.

FIG. 5 is an explanatory graph illustrating electromagnetic field simulation results of reflection characteristics in each of a standing-wave array antenna and a traveling-wave array antenna.

The antenna devices of the first and second embodiments are traveling-wave array antennas. Hereinafter, comparison is made between reflection characteristics of a general standing-wave array antenna and reflection characteristics of a traveling-wave array antenna.

In FIG. 5, a curve 51 represents the reflection characteristic of the standing-wave array antenna, and a curve 52 represents the reflection characteristic of the traveling-wave array antenna.

The amplitude of the reflection wave indicated by the curve 52 is smaller than the amplitude of the reflection wave indicated by the curve 51 at each frequency.

Therefore, it can be understood that the antenna devices according to the first and second embodiments, which are traveling-wave array antennas, can implement broadband characteristics as compared with the standing-wave array antenna.

Figure 6:
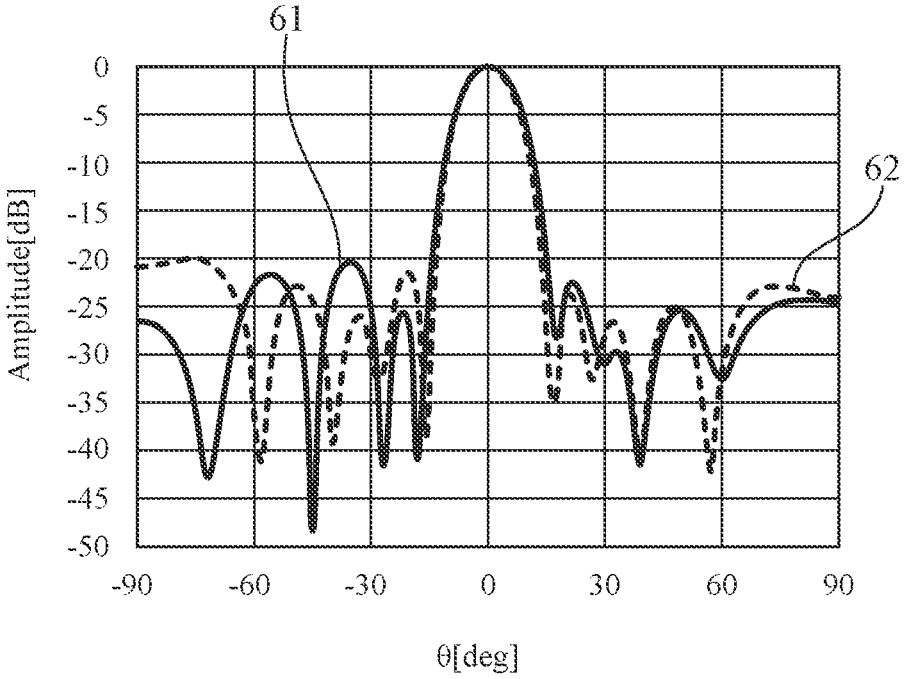
FIG. 6 is an explanatory graph illustrating electromagnetic field simulation results of radiation patterns in each of a standing-wave array antenna and a traveling-wave array antenna.

FIG. 6 is an explanatory graph illustrating electromagnetic field simulation results of radiation patterns in each of a standing-wave array antenna and a traveling-wave array antenna.

In FIG. 6, a curve 61 indicates a radiation pattern of the main polarized wave of an electromagnetic wave radiated from the traveling-wave array antenna.

The curve 61 illustrates an example in which the beam direction of the main polarized wave is the front direction of the antenna device.

The antenna devices according to the first and second embodiments, which are traveling-wave array antennas, are fed with an electromagnetic wave from the feeding unit 3 coupled to one end of the feed line 4 unlike in the antenna device of Patent Literature 1 in which an electromagnetic wave is fed from a feeding point included at the center of a feed line 4. However, as is clear from the curve 61, the antenna devices of the first and second embodiments, which are traveling-wave array antennas, can also direct the beam direction of the main polarized wave to the front direction of the antenna device.

A curve 62 indicates a radiation pattern of the main polarized wave of an electromagnetic wave radiated from the standing-wave array antenna.

Also in the radiation pattern indicated by the curve 62, the beam direction of the main polarized wave is directed toward the front direction of the antenna device.

Both the standing-wave array antenna and the traveling-wave array antenna have a side lobe level of about −20 dB or less and a cross polarization level of −50 dB or less, thus exhibiting good characteristics.

Third Embodiment

In the antenna devices according to the first and second embodiments, the radiation elements 5-1 to 5-4 have rectangular shapes.

However, the shape of the radiation elements 5-1 to 5-4 is not limited to a rectangular as long as each of the impedance matching portions 6-1 to 6-4 and the power adjustment portions 7-1 to 7-3 can be formed. For example, an elliptical shape may be used, or a triangle or a polygon having five or more sides may be used.

Figure 7:
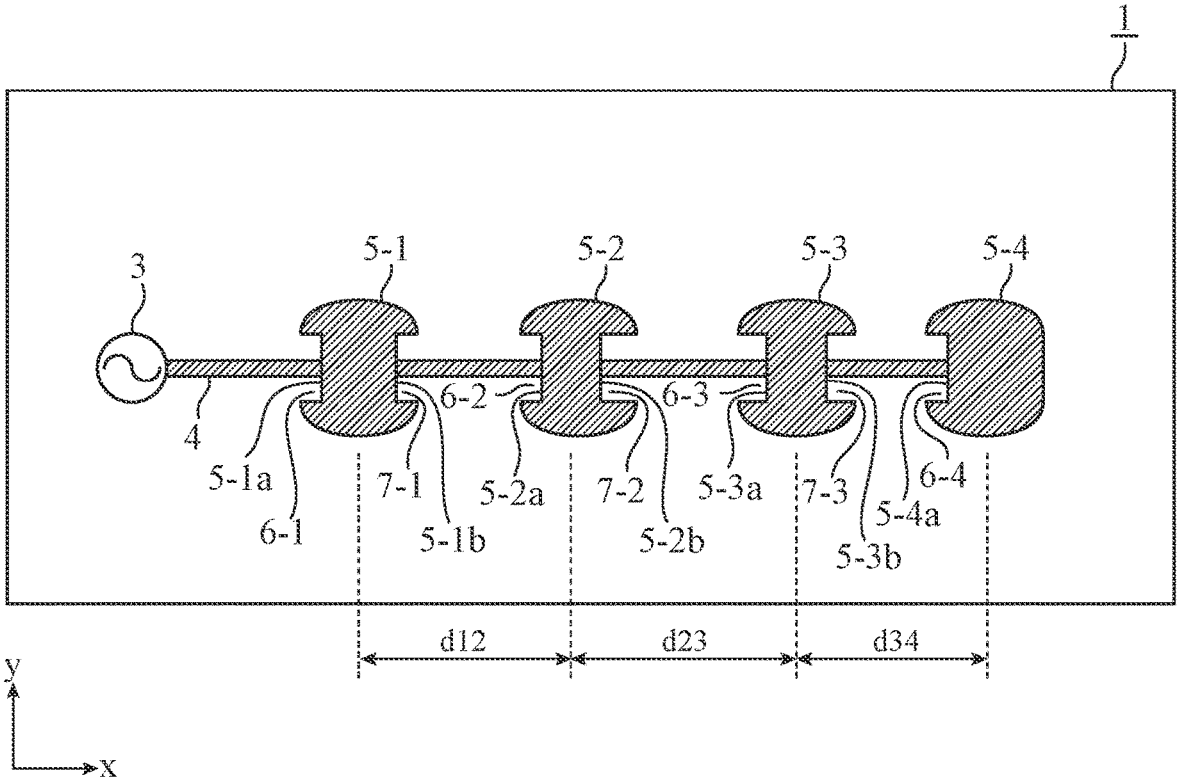
FIG. 7 is a plan view illustrating an antenna device according to a third embodiment.
Figure 8:
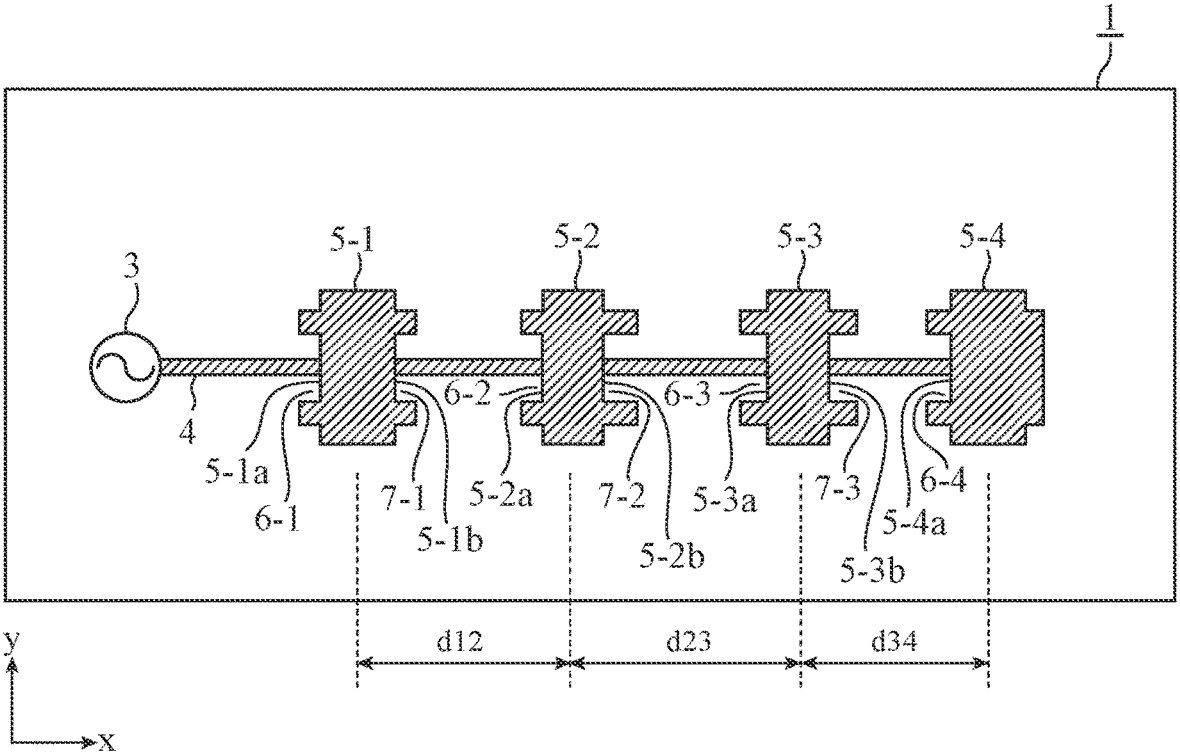
FIG. 8 is a plan view illustrating an antenna device according to a third embodiment.

FIG. 7 and FIG. 8 are plan views illustrating an antenna device according to a third embodiment.

In FIG. 7, an example is illustrated in which radiation elements 5-1 to 5-4 have an elliptical shape.

In FIG. 8, an example is illustrated in which radiation elements 5-1 to 5-4 have a polygonal shape.

In FIGS. 7 and 8, the same symbol as that in FIG. 1A represents the same or a corresponding part.

Even in a case where the radiation elements 5-1 to 5-4 have an elliptical or polygonal shape, the radiation elements 5-1 to 5-4 can emit electromagnetic waves like in the case where the shape is rectangular.

The shape of the radiation elements 5-1 to 5-4 here refers to the shape of the radiation elements 5-1 to 5-4 in which no recessed portions are formed as the impedance matching portions 6-1 to 6-4 nor as the power adjustment portions 7-1 to 7-3.

Fourth Embodiment

In the antenna devices of the first to third embodiments, the radiation elements 5-1 to 5-4 are arrayed in a line.

In a fourth embodiment, an antenna device in which radiation elements 5-1 to 5-4 are arrayed in two or more rows will be described.

Figure 9:
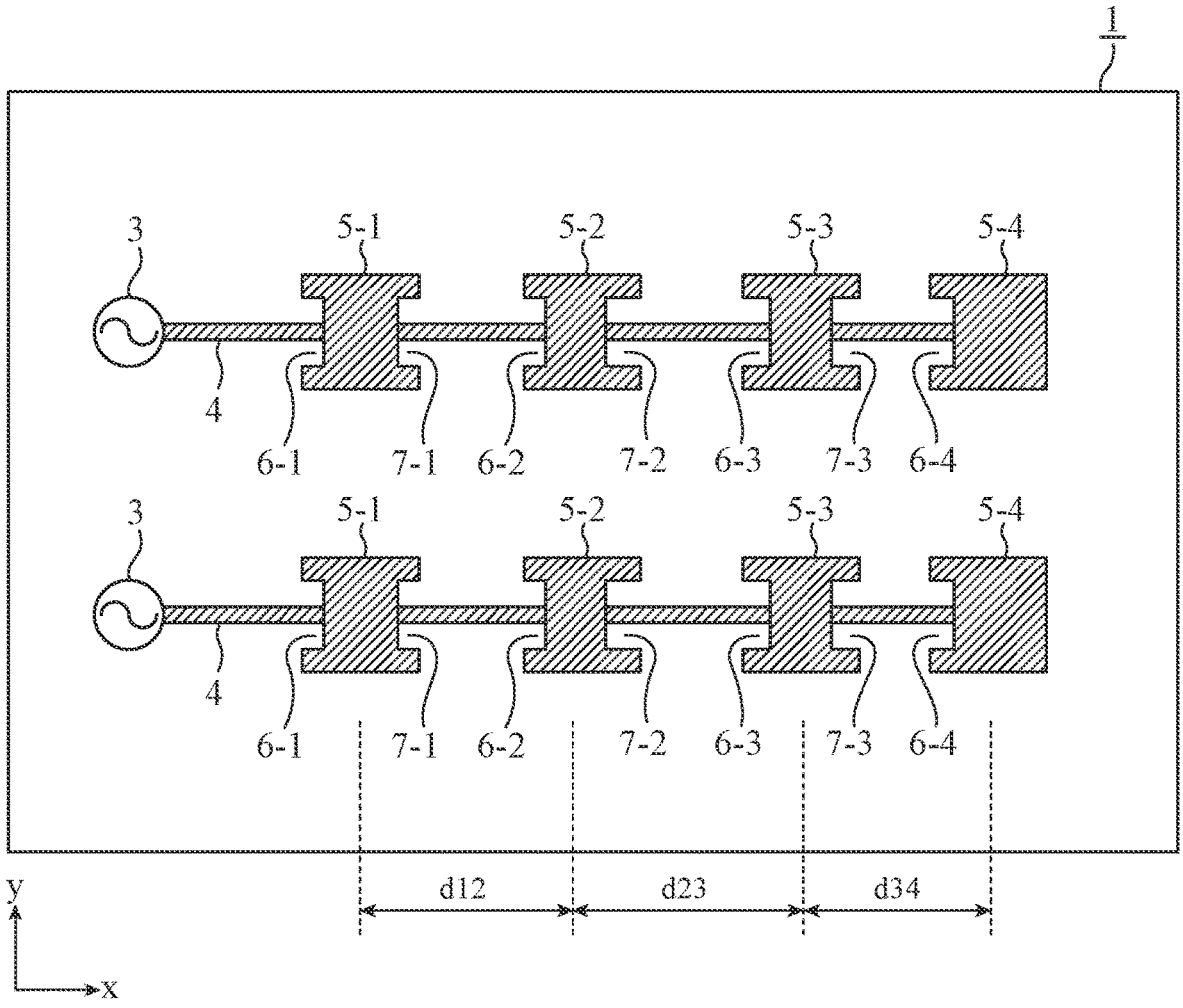
FIG. 9 is a plan view illustrating an antenna device according to a fourth embodiment.

FIG. 9 is a plan view illustrating an antenna device according to a fourth embodiment.

In FIG. 9, the same symbol as that in FIG. 1A represents the same or a corresponding part, and thus description thereof is omitted.

In the antenna device illustrated in FIG. 9, two array antennas are formed on a dielectric substrate 1 with a set of a feeding unit 3, a feed line 4, and radiation elements 5-1 to 5-4 serving as one array antenna. In the antenna device illustrated in FIG. 9, the feed lines 4 included in the two array antennas are formed substantially parallel to each other.

The antenna device illustrated in FIG. 9 illustrates an example in which two array antennas are formed; however, it is only required that a plurality of array antennas be formed, and three or more array antennas may be formed. Feed lines 4 included in three or more array antennas are formed substantially parallel to each other.

In the antenna device illustrated in FIG. 9, electromagnetic waves having different orientations θ can be emitted from the radiation elements 5-1 to 5-4 included in the two array antennas. Meanwhile, electromagnetic waves having the same orientation θ can also be emitted from the radiation elements 5-1 to 5-4 included in the two array antennas.

Note that the present invention may include a flexible combination of each embodiment, a modification of any component of each embodiment, or an omission of any component in each embodiment within the scope of the present invention.

INDUSTRIAL APPLICABILITY

The present invention is suitable for an antenna device including a plurality of radiation elements.

REFERENCE SIGNS LIST

1: dielectric substrate, 1*a*: first plane, 1*b*: second plane, 2: ground conductor, 3: feeding unit, 4: feed line, 5-1 to 5-4: radiation element, 5-1*a* to 5-4*a*: coupling portion, 5-1*b* to 5-3*b*: coupling portion, 6-1 to 6-4: impedance matching portion, 7-1 to 7-3: power adjustment portion, 8-1, 8-2: hole, 21, 22: excitation amplitude distribution, 41, 42, 51, 52, 61, 62: curve

The invention claimed is:

1. An antenna device comprising:

a feeder to feed an electromagnetic wave;

a ground conductor;

a substrate having a first plane on which the feeder is formed and a second plane on which the ground conductor is formed, the second plane being opposite to the first plane;

a feed line having one end coupled with the feeder, the feed line being a strip conductor formed on the first plane; and N (N is an integer greater than 2) radiation elements formed by a strip conductor in the feed line, each of the N radiation elements comprising one or more coupling portions to the feed line, wherein each of a first to an (N−1)th radiation elements out of the N radiation elements, when counted from the feeder side, is formed with a recessed portion for adjusting power of the electromagnetic wave that passes through the respective radiation element as a power adjustment portion atone of the one or more coupling portions to the feed line that is on an opposite side of the feeder, wherein one or more radiation elements out of the N radiation elements are formed with a hole, and wherein each of the N radiation elements is formed with another recessed portion on a side facing the feeder for adjusting an input impedance of the respective radiation element as an impedance matching portion at a respective coupling portion on the feeder side out of the one or more coupling portions to the feed line.

2. The antenna device according to claim 1, wherein a line length of the feed line between an i-th (i is an integer in a range between 1 and (N−1)) radiation element and an (i+1)th radiation element among the N radiation elements, when counted from the feeder side, is given by a length with which a sum of a first passing phase that is a phase of an electromagnetic wave passing through the i-th radiation element and a second passing phase that is a phase of an electromagnetic wave passing through the feed line between the i-th radiation element and the (i+1)th radiation element satisfies a conditional expression below:

$$\varphi_1(i)+\varphi_2(i)=-k\times d(i)\times\sin\theta+2m\pi, \qquad \text{[Conditional Expression]}$$

where $\varphi_1(i)$ denotes the first passing phase, $\varphi_2(i)$ denotes the second passing phase, k denotes the wave number at a used frequency of the electromagnetic wave, d(i) denotes the line length of a feed line between an i-th radiation element and an (i+1)th radiation element, θ denotes an orientation of the electromagnetic wave which is represented by an angle formed with respect to a front direction of the antenna device, and m is an integer.

3. The antenna device according to claim 1, wherein the radiation elements have a polygonal shape.

4. The antenna device according to claim 1, wherein the radiation elements have an elliptical shape.

5. The antenna device according to claim 1, wherein a plurality of sets of the feeder, the feed line, and the N radiation elements is formed on the substrate.

* * * * *